US007194871B2

(12) United States Patent
De Bernardi et al.

(10) Patent No.: US 7,194,871 B2
(45) Date of Patent: Mar. 27, 2007

(54) ELECTRICAL AND ELECTRONIC COMPONENT CABINET FOR A REFRIGERATION COMPRESSOR

(75) Inventors: Jean De Bernardi, Lyons (FR); Michel Augagneur, Civrieux (FR); Renaat Vandelanotte, Ghen (BE); Yves Rosson, Villars les Dombes (FR)

(73) Assignees: Danfoss Commercial Compressors, Reyrieux (FR); Carrier Corporation, Farmington, CT (US)

( * ) Notice: Subject to any disclaimer, the term of this patent is extended or adjusted under 35 U.S.C. 154(b) by 0 days.

(21) Appl. No.: 10/827,344

(22) Filed: Apr. 20, 2004

(65) Prior Publication Data

US 2005/0229621 A1 Oct. 20, 2005

(51) Int. Cl.
*F25D 19/00* (2006.01)

(52) U.S. Cl. ..... 62/298

(58) Field of Classification Search ..... 62/259.1, 62/295, 298, 508, 289; 417/423.14, 902; 220/3.8; 310/89; 174/67; 439/367; 471/423.14, 471/902, 90

See application file for complete search history.

(56) References Cited

U.S. PATENT DOCUMENTS

| | | | | |
|---|---|---|---|---|
| 3,771,321 | A * | 11/1973 | Maksy | 62/298 |
| 3,782,580 | A * | 1/1974 | Pedersen et al. | 220/4.02 |
| 3,943,728 | A * | 3/1976 | Maudlin | 62/507 |
| 4,398,400 | A * | 8/1983 | Bar | 62/508 |
| 5,199,898 | A * | 4/1993 | Wisner | 439/367 |
| 5,333,460 | A * | 8/1994 | Lewis et al. | 62/6 |
| 6,290,528 | B1 * | 9/2001 | Moore et al. | 439/367 |
| 6,302,654 | B1 * | 10/2001 | Millet et al. | 417/63 |
| 6,305,989 | B1 * | 10/2001 | Quadir | 439/685 |
| 6,318,105 | B1 * | 11/2001 | Bushnell et al. | 62/262 |
| 6,375,439 | B1 * | 4/2002 | Missio | 417/410.1 |
| 6,438,985 | B1 * | 8/2002 | Hayashi | 62/298 |
| 6,752,646 | B2 * | 6/2004 | McCoy | 439/367 |
| 6,870,098 | B2 * | 3/2005 | Robbins | 174/50.5 |

FOREIGN PATENT DOCUMENTS

| | | | |
|---|---|---|---|
| DE | 44 12 840 | A1 | 10/1995 |
| DE | 19642148 | A1 * | 4/1998 |
| EP | 0 793 068 | A | 9/1997 |
| FR | 85 734 | E | 10/1965 |
| FR | 2 028 340 | A | 10/1970 |
| JP | 6-26461 | A * | 2/1994 |
| JP | 10-238466 | A * | 9/1998 |
| JP | 2000-121210 | A * | 4/2000 |
| JP | 2002-285962 | A * | 10/2002 |

* cited by examiner

*Primary Examiner*—Mohammad M. Ali
(74) *Attorney, Agent, or Firm*—Oliff & Berridge, PLC

(57) ABSTRACT

Cabinet for a refrigeration compressor delimiting an inner space designed to receive electrical and electronic components, characterized by having at least one support for the electrical and electronic components and a protective cap having an open side face delimited by an edge whose shape at least partially matches the shape of the side wall of compressor, cap being intended to be applied by its open side face against the side wall of the compressor, thus forming one of the walls of the cabinet. The cabinet accommodates the electrical and electronic command, control, and protection components on refrigeration compressors ensuring that the electrical and electronic components are held at their operating temperature and that tightness and vibrations are at an acceptable level.

10 Claims, 2 Drawing Sheets

ELECTRICAL AND ELECTRONIC COMPONENT CABINET FOR A REFRIGERATION COMPRESSOR

BACKGROUND OF THE INVENTION

The present invention relates, in general, to refrigeration compressors. This invention relates in particular to a command and/or control and/or protection unit for a refrigeration compressor.

1. Field of Invention

Compressors currently in use have a terminal box for electrical connection containing a small number of components providing command, control, and protection functions. In current applications, although the acquisition and regulation devices are near the compressor, the command, control, and protection part is centralized, for several compressors, in one unit in the refrigerating machine or facility. It is then necessary to have a complex processor that controls all the inputs and outputs for the compressors. As a result, these complex processors and the cabinets containing them are specific to each compressor configuration on these machines. This causes high costs because these components are non-standard and require configuration and installation at the actual assembly site of the refrigerating machine or facility. This equipment is complex, difficult to test, and has defects that appear only after assembly, which can lead to low quality or defects at the customer's facility. Moreover, in the centralized equipment currently in use, these various command, control, and protection components used for compressors are dimensioned taking into account the operational environment. In particular, the high temperature in the cabinet due to the heat dissipation of these components and those used in other functions of the machine.

2. Related Art

A new approach consists of standardizing and optimizing the command, control, and protection functions and placing the components supporting these functions close to or in the compressor. Hence, the processor becomes standard as far as the compressor functions are concerned, using a bus link. The compressor and its cabinet become a simple, standard unit from the manufacturer which is tested well before final installation. The risks of defects after assembly of the refrigeration system are thus limited.

When the electrical components responsible for command, control, and protection are brought as close as possible to the compressor, they must be placed under favorable conditions, in terms of:

Heat exchange, allowing for smaller and hence cheaper electrical and electronic components which however require significant cooling;

Vibration level; and

Tightness.

SUMMARY OF THE INVENTION

The present invention enables the components to be placed under the conditions described above using, in particular, the heat exchange properties of the side wall of the refrigeration compressor.

For this purpose, the present invention according to one exemplary embodiment relates to a cabinet for a refrigeration compressor delimiting an inner space designed to receive electrical and electronic components, characterized by having:

At least one support for the electrical and electronic components; and

A protective cap having an open side face delimited by an edge whose shape at least partially matches the shape of the side wall of the compressor, the cap being designed to be applied by its open side face against the side wall of the compressor, thus forming one of the walls of the cabinet.

The opening in the cabinet on the compressor wall enables the compressor wall to be used to cool the cabinet and the electrical and electronic components that it contains.

This is because the side wall of the compressor is in contact with the suction chamber of the compressor. Thus, the wall is in contact with the suction gas, which is cold because it comes from an evaporator located upstream of the compressor in a cooling circuit. For example, for one type of refrigeration compressor that is in use, the temperature range of the suction gas is between −20° C. and +25° C. The temperature of the wall is substantially equal to the temperature of the gas and thus varies between the same values. The wall is hence a source of cooling that can be used for the cabinet.

Advantageously, the support for the electrical and electronic components has at least one horizontal plate attached at one of its ends to the side wall of the compressor, and covered by the cap. This arrangement enables the electrical and electronic components to be mounted on a stable support and the cabinet to then be closed by the cap.

The invention is also characterized in that in one exemplary embodiment the protective cap has seals on at least part of its edge in contact with the side wall of compressor. These seals ensure protection when the compressor is washed for example, or if it is exposed to the weather.

The invention is also characterized in that in one exemplary embodiment the protective cap has a convex general shape. This cap shape prevents liquids from collecting on the seals.

The invention is also characterized in that in one exemplary embodiment the support is designed to allow liquid residues to be evacuated. This arrangement evacuates liquid residues coming from condensation, ice melt, or washing residues. The side wall of the compressor may collect condensation under wet conditions, or become iced over because of its low temperature.

Advantageously, the support is attached to the lower part of the compressor. This arrangement minimizes vibrations to which the electrical and electronic components are subjected.

Advantageously, the support has means for attaching the protective cap. The connection between the cap and the support makes the cabinet sturdier.

According to one option, the support is made of plastic supporting the wiring and attachment of the electrical and electronic components. This approach reduces assembly time and reduces the risk of quality defects.

According to one option, the support is made of metal. This approach guarantees simple and inexpensive reduction to practice.

Advantageously, the protective cap is made of ABS (acrylonitrile butadiene styrene). ABS (acrylonitrile butadiene styrene) has good mechanical strength and high thermal inertia.

The invention will be better understood with the aid of the following description, with reference to the attached schematic drawings.

DETAILED DESCRIPTION OF PREFERRED EMBODIMENTS

Figure 1:
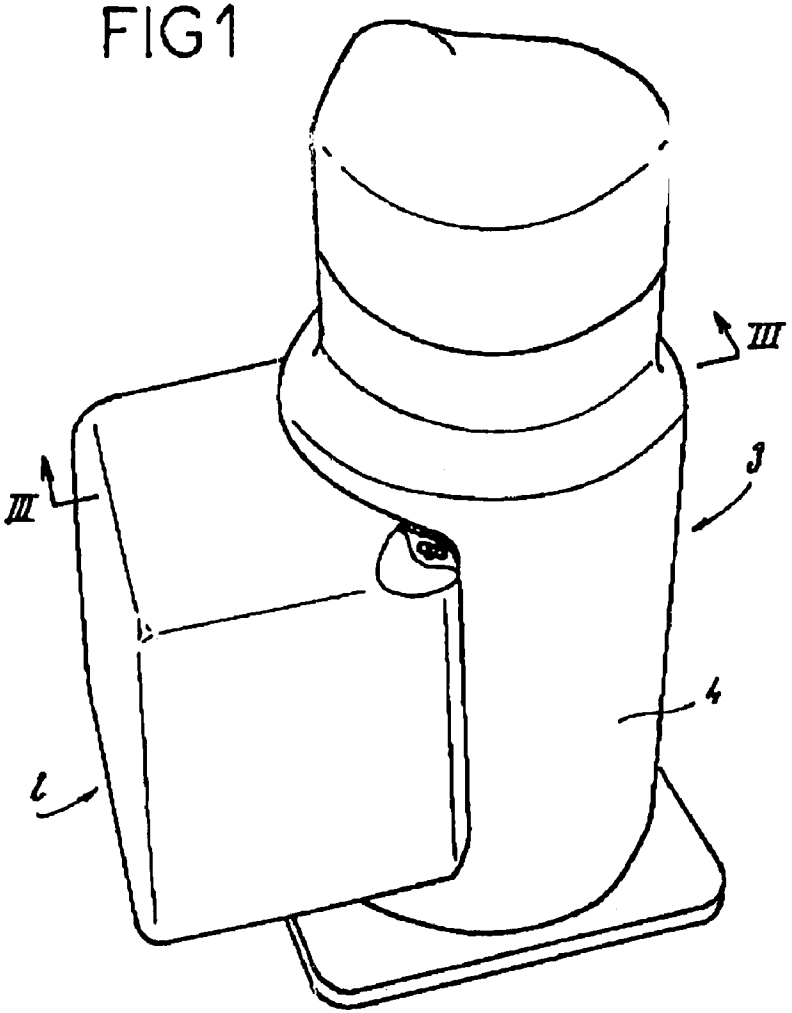
FIG. 1 is a general view wherein the cabinet is attached to the side wall of a compressor.

FIG. 1 shows the cabinet 2 attached to the side wall 4 of a refrigeration compressor 3.

Figure 2:
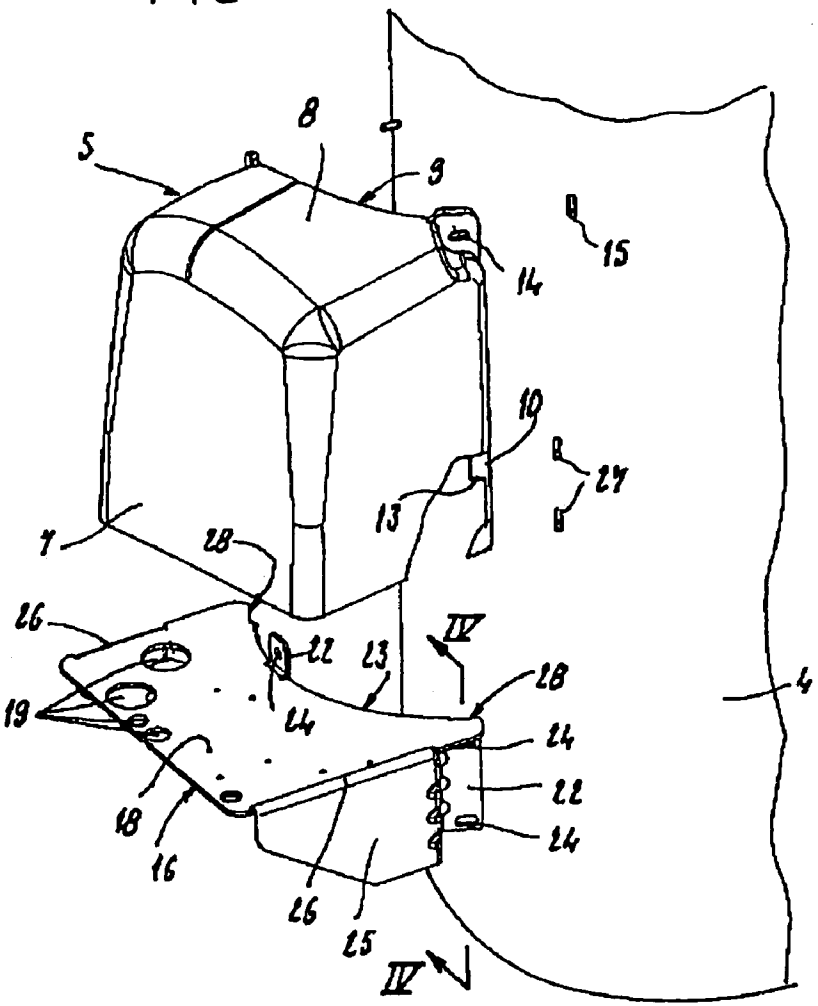
FIG. 2 is an exploded perspective view.

FIG. 2 shows the components of cabinet 2 according to one embodiment. The cabinet has a protective cap 5 as well as a horizontal plate 16 which, with side wall 4 of compressor 3 that delimits the inside space of cabinet, accommodating the electrical and electronic components 6 that can be seen in FIG. 3.

Figure 3:
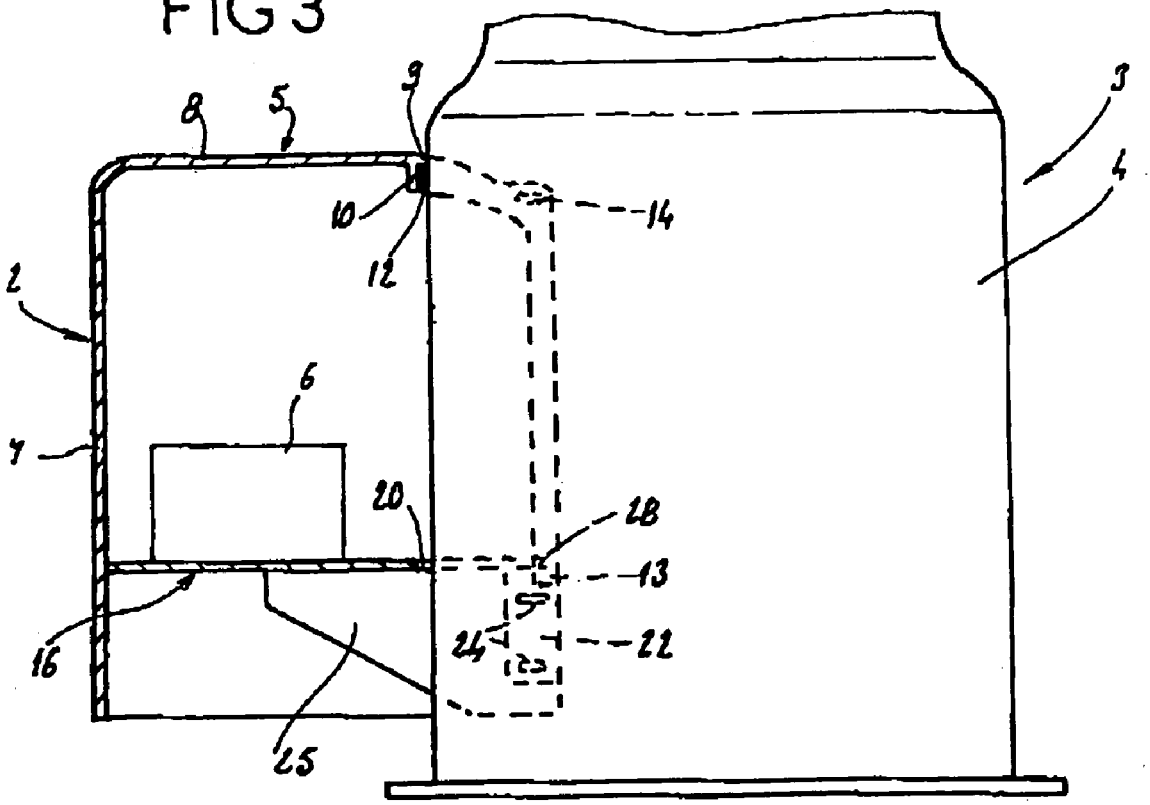
FIG. 3 is a lengthwise section on an enlarged scale along III—III in FIG. 2.
Figure 4:
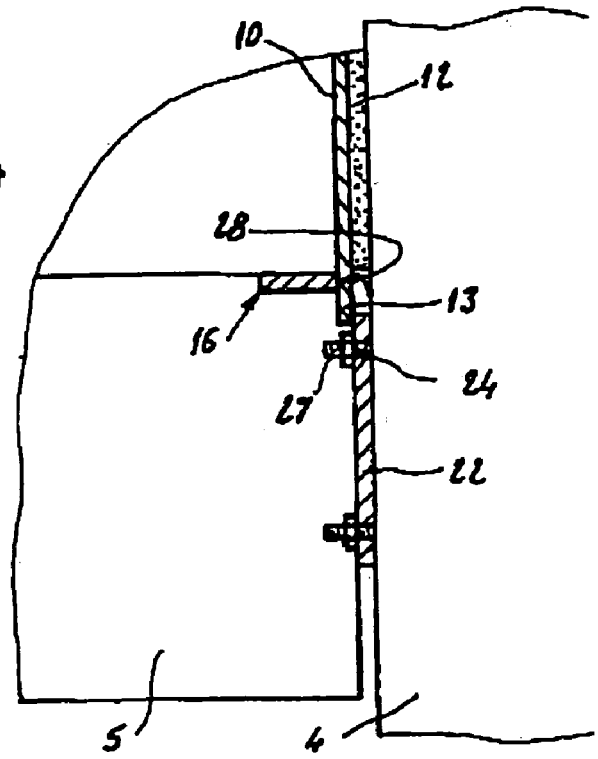
FIG. 4 is a partial lengthwise section on an enlarged scale along IV—IV in FIG. 2.

To minimize the vibrations to which the electrical and electronic components 6 are subjected, horizontal plate 16 is attached to the lower part of compressor 3 and, moreover, the electrical and electronic components 6 are attached vertically. FIGS. 2, 3, and 4 show these elements in detail.

Protective cap 5 has a general convex shape to prevent liquid from collecting. This cap 5 is made of a material that has good mechanical strength as well as high thermal inertia such as acrylonitrile butadiene styrene (ABS). This cap has three vertical and substantially planar surfaces 7, as well as a convex upper face 8. This cap 5 has an open bottom to allow passage of plate 16, and a side opening delimited by an edge 9. This edge 9 is designed to be applied against the side wall 4 of compressor 3 and hence has a shape matching the shape of this wall 4. A tab 10, partially covered with a peripheral seal 12, is provided on edge 9. The lower part of tab 10, not covered by a seal, forms a lug 13 designed to be locked in relation to plate 16 to attach protective cap 5. Protective cap 5 has, on the upper part of its edge 9, attaching means in the form of holes 14 for the studs to pass.

The side wall 4 of the compressor has studs 15 enabling protective cap 5 to be attached through holes 14. Tightening on the studs 15 is blocked by contact with a groove, not shown, on cap 5. The peripheral seal 12 is then compressed optimally against the side wall 4 of compressor 3 and the tab 10 of cap 5 to ensure tightness.

According to one embodiment, the horizontal plate 16 has threaded holes 18 for attaching the electrical and electronic components 6. Openings 19 provided in horizontal plate 16 allow power cords to pass through.

Vertical fins 25 provided on the side edges 26 of horizontal plate 16 guide the protective cap 5 when cabinet 2 is closed and hold it in position.

The horizontal plate 16 has a front edge 23 having a shape that matches that of the side wall 4 of compressor 3.

Vertical fins 22 are provided on this front edge 23 as well as the front edge of vertical fins 25, in which holes 24 enabling plate 16 to be attached to the side wall 4 of compressor 3 are provided.

Vertical fins 22 extend in front of edge 23 of horizontal plate 16 to form a 2 mm wide groove 20 between the front edge 23 of the plate and the side wall 4 of compressor 3 when horizontal plate 16 is attached to side wall 4 of compressor 3. This groove evacuates liquid residues coming in particular from condensation or melting ice on the side wall 4 of compressor 3 or from the washing fluid when cabinet 2 and/or compressor 3 are washed.

In addition, plate 16 has areas engaging the lugs 13 of the cabinet that are provided on its front edge 23 forming grooves 28 when the plate is attached to the side wall 4 of compressor 3. These grooves 28 lock the lugs 13 on the tab 10 of edge 9 of protective cap 5 so that the cap is held in position when cabinet 2 is closed.

The support described in the form of an independent plate 16 of protective cap 5 can also be integral with this cap.

The side wall 4 of compressor 3 has studs 27 for attaching horizontal plate 16 through holes 24 provided for the purpose.

The electrical and electronic components 6 that can be seen in FIG. 3 may have the following functions:

Regulation, using sensors of physical parameters such as pressure, temperature, current vibrations, etc.;

Control, by a compressor command and regulation card;

Command, by a starter combining the functions of contact switch; progressive starter, speed regulator, etc.;

Individual feed, using a rectifier and direct current; and

Protection, combining an oil pan, compressor motor temperature sensors, current threshold detectors, vibration threshold detectors, etc.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A cabinet for a refrigeration compressor delimiting an inner space designed to receive electrical and electronic components, comprising:

at least one support for the electrical and electronic components; and a cap having an open side face delimited by an edge whose shape at least partially matches the shape of a side wall of the compressor, the cap being intended to be applied by its open side face against the side wall of the compressor, thus forming a wall of the cabinet;

wherein the cap has seals on at least part of its edge in contact with the side wall of the compressor; and wherein the at least one support, the cap and the side wall of the compressor define and sufficiently enclose the inner space of the cabinet, such that the side wall of the compressor is in direct contact with the inner space of the cabinet to cool the cabinet and the electrical and electronic components.

2. The cabinet according to claim 1, wherein the support for the electrical and electronic components comprises at least one horizontal plate attached at one of its ends to the side wall of the compressor, and covered by the cap.

3. The cabinet according to claim 1, wherein the cap has a convex general shape.

4. The cabinet according to claim 1, wherein the support is designed to enable liquid residues to be evacuated.

5. The cabinet according to claim 1, wherein the support is attached to the lower part of the compressor.

6. The cabinet according to claim 1, wherein the support has means for attaching the cap.

7. The cabinet according to claim 1, wherein the support is made of plastic supporting the wiring and attachment of the electrical and electronic components.

8. The cabinet according to claim 1, wherein the support is made of metal.

9. The cabinet according to claim 1, wherein the protective cap is made of ABS (acrylonitrile butadiene styrene).

10. A cabinet for enclosing at least one of an electrical component and an electronic component for use with a refrigeration compressor, the refrigeration compressor defining a side wall having an operating temperature during compressor operation below ambient temperature, the cabinet comprising:

a support defining an upper face that contacts and supports the at least one electrical component and electronic component; and a cap having a concave side defined by an edge that at least partially substantially corresponds to a shape of the side wall, the cap being connected to the support and the side wall such that the upper face, the cap and the side wall define an inner space that is sufficiently sealed to enable the side wall to cool the inner space to a temperature below the ambient temperature.

* * * * *